US006923244B2

(12) United States Patent
Motegi et al.

(10) Patent No.: US 6,923,244 B2
(45) Date of Patent: Aug. 2, 2005

(54) POURING APPARATUS FOR CASTINGS

(75) Inventors: Tetsuichi Motegi, 6-41-25-105 Futawahigashi, Funabashi-shi, Chiba (JP); Kiichi Miyazaki, 2272-7 Kaminote, Tamamura-machi, Sawa-gun, Gunma (JP); Yoshitomo Tezuka, Hachiouji (JP); Kiyotaka Yoshihara, 2-15-2 Higashichuo, Fukushima-shi, Fukushima (JP)

(73) Assignees: Tetsuichi Motegi, Funabashi (JP); Kiichi Miyazaki, Sawa-gun (JP); Yoshimoto Tezuka, Hachiouji (JP); Kiyotaka Yoshihara, Fukushima (JP); Seiko Idea Center Co., Ltd., Tokyo (JP)

( * ) Notice: Subject to any disclaimer, the term of this patent is extended or adjusted under 35 U.S.C. 154(b) by 121 days.

(21) Appl. No.: 10/184,821

(22) Filed: Jul. 1, 2002

(65) Prior Publication Data

US 2003/0000676 A1 Jan. 2, 2003

(30) Foreign Application Priority Data

Jul. 2, 2001 (JP) ..... 2001-200790

(51) Int. Cl.[7] ..... B22D 17/10; B22D 23/00; B22D 25/00

(52) U.S. Cl. ..... 164/316; 164/113; 164/312; 164/900

(58) Field of Search ..... 164/113, 316–318, 164/900, 312

(56) References Cited

U.S. PATENT DOCUMENTS

| | | | | | |
|---|---|---|---|---|---|
| 4,591,476 | A | * | 5/1986 | Greenwood et al. | 264/328.14 |
| 4,592,407 | A | * | 6/1986 | Yamaguchi et al. | 164/265 |
| 5,699,849 | A | * | 12/1997 | Fink | 164/155.4 |
| 5,983,976 | A | * | 11/1999 | Kono | 164/113 |
| 2001/0037868 | A1 | * | 11/2001 | Flemings et al. | 164/113 |

FOREIGN PATENT DOCUMENTS

| | | |
|---|---|---|
| CH | 359844 | 1/1962 |
| DE | 100 52 638 | 5/2002 |
| EP | 0 535 421 | 4/1993 |

* cited by examiner

*Primary Examiner*—Kuang Y. Lin
(74) *Attorney, Agent, or Firm*—Oblon, Spivak, McClelland, Maier & Neustadt, P.C.

(57) ABSTRACT

A pouring apparatus for castings uses separate systems for supplying billets and delivering the semi-molten material, making it possible to readily modify the discharge flows and pressure. A pouring apparatus for castings that comprises solid material supply means for supplying solid material to a melting basin; heating means for heating the melting basin to semi-melt solid material supplied to the melting basin; a conveyance chamber provided adjacent to the melting basin; and delivery means for discharging, from a discharge nozzle, semi-molten material conveyed from the melting basin to the conveyance chamber.

3 Claims, 2 Drawing Sheets

POURING APPARATUS FOR CASTINGS

BACKGROUND OF THE INVENTION

1. Field of the Invention

The present invention relates to a pouring apparatus used for casting metals containing various alloys, and more particularly to a pouring apparatus used for pouring metal in a semi-solid or semi-molten state that contains globular metal crystals into metal molds.

2. Description of the Prior Art

FIG. 3 shows an example of a conventional pouring apparatus used in the casting of metals. As shown, when metal material M has been charged into a preheating barrel 1, a preheater 3 and a heater 4 of a heating chamber 2 are driven. After the metal material M placed into the preheating barrel 1 is supplied to the heating chamber 2 by the reciprocal action of a plunger 5, the metal material M is maintained in a semi-molten state in the heating chamber 2. While the metal material M is in the preheating barrel 1 it is heated by the preheater 3, so that after it reaches the heating chamber 2, it can be promptly placed into a semi-molten state.

When there is a prescribed amount of the semi-molten metal material $M_0$ in the heating chamber 2, a ram cylinder (not shown) pushes the plunger 5 forward, and at the same time a suction rod 6 advances into the heating chamber 2. As a result, the semi-molten metal material $M_0$ in the heating chamber 2 is delivered into the mold from the outlet 7, to form the required shape. However, because the plunger 5 and suction rod 6 each communicate with the heating chamber 2, when the metal material $M_0$ is to be expelled from the outlet 7, it is not enough just to adjust the suction rod 6; in addition, it is also necessary to take the penetration of the plunger 5 into consideration. Moreover, the insertion of the metal material M into the heating chamber 2 has to be done under a constant pressure. Also, because it is difficult to seal the heating chamber 2, descaling and other such furnace cleaning tasks have been very difficult to accomplish.

In view of the above, an object of the present invention is to provide a pouring apparatus for castings in which, by using different systems to supply the solid material and to deliver the semi-molten material, enables the delivery amount and delivery pressure to be readily modified. Another object is to provide a pouring apparatus for castings that facilitates the sealing of the melting basin, preventing oxidation of the semi-molten material.

SUMMARY OF THE INVENTION

In order to attain the above object, the present invention provides a pouring apparatus for castings comprising: solid material supply means for supplying solid material to a melting basin; heating means for heating the melting basin to semi-melt solid material supplied to the melting basin; a conveyance chamber provided adjacent to the melting basin; and delivery means for discharging, from a discharge nozzle, semi-molten material conveyed from the melting basin to the conveyance chamber.

The above pouring apparatus for castings can include a shield block disposed between the solid material supply means and the melting basin. The solid material supply means can be connected to the melting basin at a prescribed angle of inclination to the horizontal plane.

As described above, the pouring apparatus for castings according to the present invention uses separate systems for supplying the solid material and delivering the semi-molten material, making it possible to readily modify the discharge amount and discharge pressure. Also, the melting basin and conveyance chamber are provided separately so the melting basin is sealed, preventing oxidation of the material heated to a semi-molten state therein.

Moreover, the provision of a shield block between the solid material supply means and the melting basin prevents backflow of the semi-molten material in the solid material supply means. Also, the solid material supply means is connected to the melting basin at a prescribed angle of inclination to the horizontal plane, which makes it possible for the solid material to be steadily inserted by the drive cylinder without dropping into the melting basin.

Further features of the invention, its nature and various advantages will be more apparent from the accompanying drawings and following detailed description of the invention.

DESCRIPTION OF THE PREFERRED EMBODIMENTS

Figure 1:
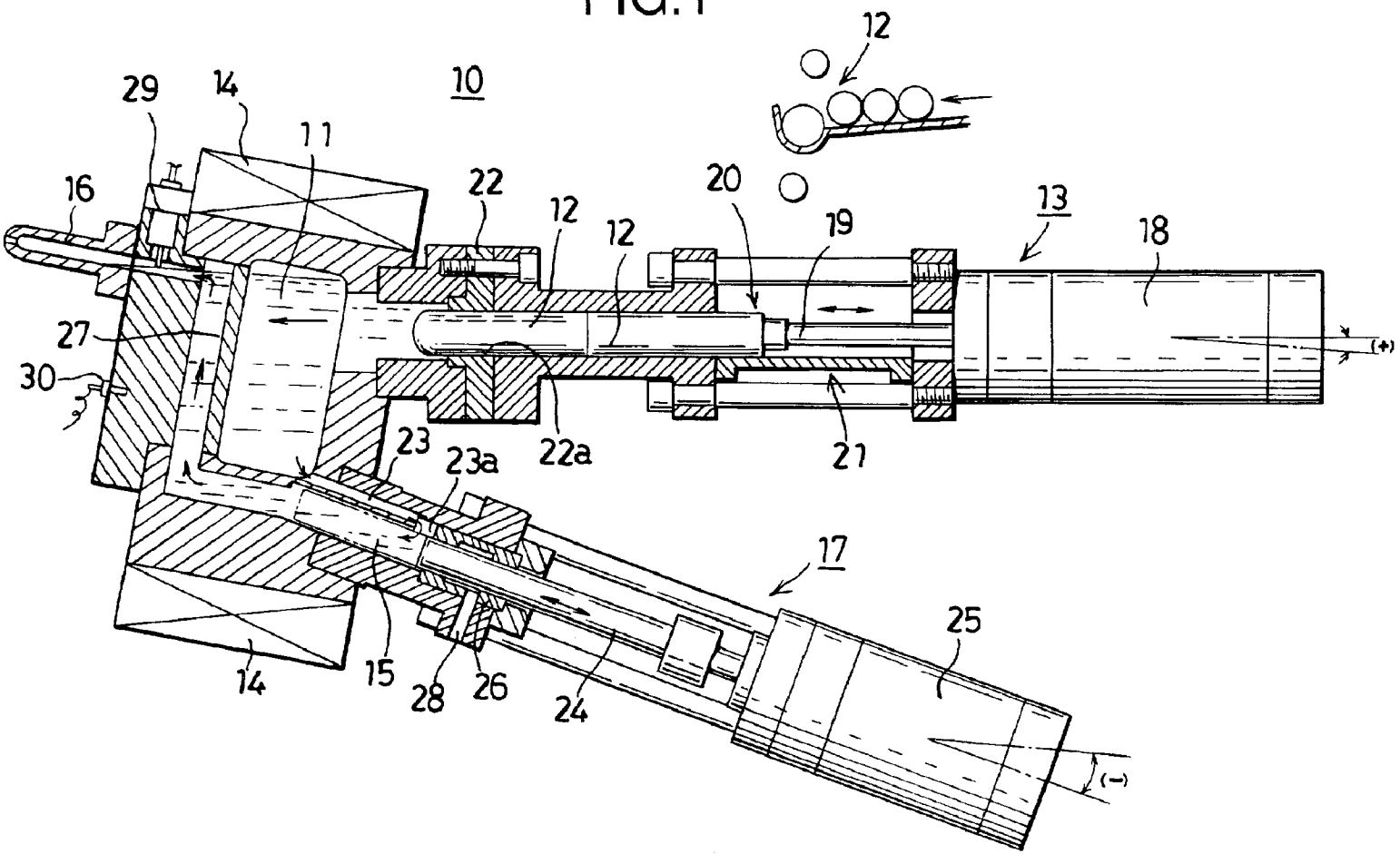
FIG. 1 is a cross-sectional view of an embodiment of the pouring apparatus for castings of the present invention.

FIG. 1 is a cross-sectional view of an embodiment of the pouring apparatus for castings of the present invention. The pouring apparatus for castings of the present invention shown in FIG. 1 comprises a solid material supply means 13 that feeds solid material 12 into a melting basin 11, a heating means 14 for heating the melting basin 11 to semi-melt solid material 12 supplied thereto, a conveyance chamber 15 provided adjacent to the melting basin 11, and a delivery means 17 for discharging, from a discharge nozzle 16, semi-molten material conveyed from the melting basin 11 to the conveyance chamber 15.

The solid material supply means 13 comprises a hydraulic cylinder 18, a piston rod 19 disposed to be able to be axially movable back and forth by means of the hydraulic cylinder 18, an input port 20 for inputting billets constituting the solid material 12, and an ingot input port 21. The hydraulic cylinder 18 and piston rod 19 are set at an angle of 10 to 20 degrees to the horizontal. Accordingly, the hydraulic cylinder 18 can be used to fully control the volume of billets fed into the melting basin 11, so their is no danger of billets entering via the billet input port 20 falling under their own weight down into the melting basin 11.

The solid material supply means 13 is connected to the melting basin 11 via a shield block 22. The shield block 22 is formed of ceramics or the like, and has a transit port 22*a* having a diameter that is approximately the same as the outside diameter of the solid material 12. Solid material 12 inserted into the transit port 22*a* in a semi-molten state can thus be prevented from moving backwards from the input port.

A communicating passage 23 formed at the lower end of the melting basin 11 communicates the basin 11 with the conveyance chamber 15 located therebelow. The conveyance chamber 15 is thus disposed adjacent to the melting basin 11 and is attached at an angle of 10 to 20 degrees to the horizontal. A plunger 24 forming the delivery means 17 is disposed so that it can be moved into and out of the conveyance chamber 15. The plunger 24 is driven by a hydraulic cylinder 25. The delivery means 17 comprises the plunger 24 and the hydraulic cylinder 25 that is the means used to drive the plunger 24. The semi-molten material discharge amount and discharge pressure can be readily modified by adjusting the driving of the plunger 24. A shield block 26 of ceramics or the like is attached at the side where the plunger 24 enters the conveyance chamber 15, preventing leakage of the semi-molten material.

The communicating passage 23 connecting the melting basin 11 with the conveyance chamber 15 has an opening 23*a* at the end where the plunger 24 enters. Thus, the opening 23*a* is closed off by the plunger 24 when the plunger 24 moves a certain distance towards the conveyance chamber 15, shutting off the communication with the melting basin 11. When the opening 23*a* is thus closed off, discharge delivery operations by the delivery means 17 is unaffected by variations in pressure inside the melting basin 11.

The other end of the conveyance chamber 15 is connected to a channel 27 that extends to the semi-molten material discharge nozzle 16. An outlet 28 is provided at the end of the conveyance chamber 15 from where the plunger 24 enters, for extracting the semi-molten material. When the plunger 24 is further retracted, residual semi-molten material and scale and the like can be removed via the outlet 28.

The channel 27 is formed as an integral part of the melting basin 11 and conveyance chamber 15 assembly, encircled by the heating means 14. The discharge nozzle 16 is connected to the channel 27 communicated with the conveyance chamber 15, and has a level sensor 29 for detecting the level of the semi-molten material. The discharge nozzle 16 is attached at an angle of 5 to 15 degrees that elevates the end of the nozzle relative to the horizontal plane. When the level sensor 29 does not detect the liquid level of the semi-molten material, there is no delivery from the discharge nozzle 16. A heat sensor 30 is attached to the side-wall of the channel 27 to detect the surrounding temperature.

The operation of the pouring apparatus for castings thus configured will now be described. To start with, billets 12 are fed in via the input port 20, and are urged towards the melting basin 11 by the piston rod 19. Billets inside the melting basin 11 are heated to a semi-molten state by the peripherally-arranged heating means 14. The melting basin 11 is charged with the semi-molten material, which flows through the communicating passage 23 into the conveyance chamber 15, until the liquid surface reaches the level sensor 29. At that point, the plunger 24 retracts back from the conveyance chamber 15, unblocking the opening 23*a*.

Figure 2:
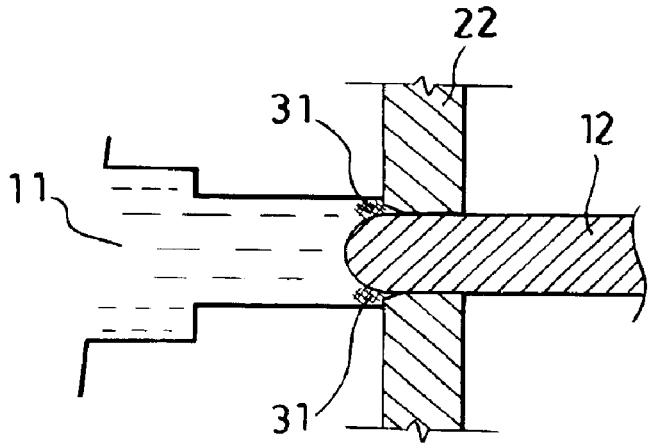
FIG. 2 is a cross-sectional view of the principal parts of the shield block used in the pouring apparatus for castings.
Figure 3:
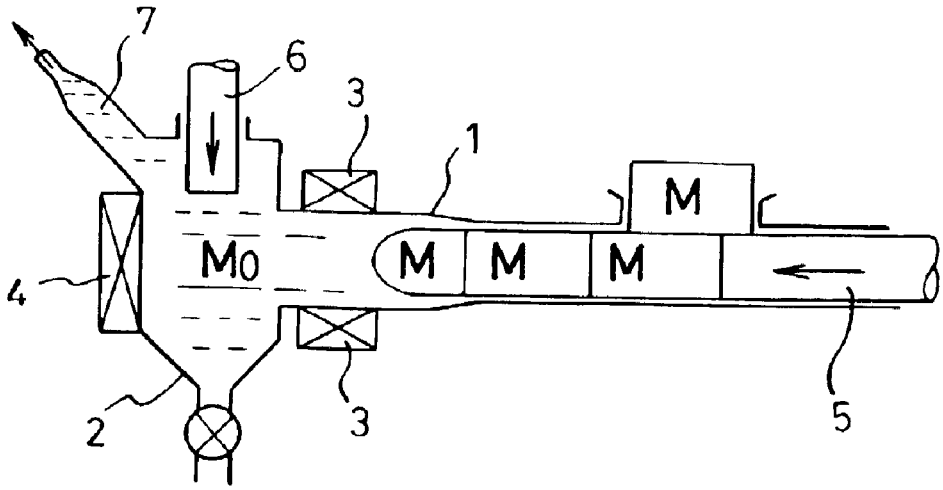
FIG.3 PRIOR ART
FIG. 3 shows the general arrangement of a pouring apparatus for castings according to the prior art.

When the plunger 24 advances, semi-molten material is expelled from the discharge nozzle 16 into a mold (not shown). The discharge amount and pressure can be adjusted by controlling the amount and speed of movement of the plunger 24. Except at the initial stage of the pouring of the material into the mold, meaning up to the point at which the opening 23*a* of communication passage 23 is closed off by the plunger 24, the delivery from the discharge nozzle 16 is not affected by increases in pressure in the melting basin 11. Also, the shield block 22 provided on the solid material supply means 13, as shown in FIG. 2, prevents the material from flowing backwards. That is, when the pressure in the melting basin 11 is raised by the action of the piston rod 19, the flow of the semi-melt to the shield block 22 produces a semi-solid portion 31 that remains stationary at high pressures, preventing any backflow.

When the pouring of the semi-melt into the mold is completed, the plunger 24 is retracted, opening the opening 23a. As a result, the level of the semi-melt falls, triggering the level sensor 29, whereupon the solid material supply means 13 goes into operation, inserting a billet 12 into the melting basin 11. When the level sensor 29 detects the rise in the liquid level in the channel 27 caused by the entry of the billet 12, the solid material supply means 13 stops operation. The repeated discharge and suction of the semi-melt in the discharge nozzle 16 prevents cooling of the semi-melt. The billets 12 can be continuously and automatically fed into the input port 20 by the reciprocating action of the cylinder piston-rod.

Thus, as described in the foregoing, in accordance with this invention, a solid material supply means 13 is used to supply the billets, and a separate delivery means 17 is used to deliver the semi-melt. This makes it possible to modify the discharge flow and pressure using just the delivery means 17, and to separate billet supply operations. Also, since the melting basin 11 is always sealed, the semi-molten material is always protected from oxidation. Because no drain valve is required along the entire extent of the plunger stroke, the amount of residual melt is minimized. Moreover, thermal efficiency is improved by the fact that the flow channel is formed as an integral part of the melting basin 11.

The present invention having the foregoing configuration provides the following effects.

The pouring apparatus for castings according to the present invention comprises a solid material supply means for supplying solid material to a melting basin, heating means for heating the melting basin to semi-melt solid material supplied to the melting basin, a conveyance chamber provided adjacent to the melting basin, and delivery means for nozzle-discharge of semi-molten material conveyed from the melting basin to the conveyance chamber. Because separate systems are used for supplying the solid material and delivering the semi-molten material, adjusting of the discharge amount and pressure is facilitated. In addition, the solid material can be supplied to the melting basin at a low pressure.

The shield block provided between the solid material supply means and the melting basin prevents backflow of the semi-molten material in the solid material supply means. Also, the solid material supply means is affixed to the melting basin at an inclined angle to the horizontal plane, enabling the billets to be steadily fed by the drive cylinder without the billets dropping down into the melting basin.

The semi-molten material can flow under its own weight from the melting basin into the conveyance chamber, forming a natural supply system. The discharge means consists of a plunger that moves in and out of the conveyance chamber, and means for driving the plunger, making it possible to readily adjust semi-molten material discharge flow and pressure by adjusting the operation of the plunger.

The conveyance chamber has an opening at a passage that communicates with the melting basin, disposed at the starting position of direction of the forward movement of the plunger. This makes it possible to reduce pressure variations imparted to the melting basin when the semi-molten material is being discharged from the nozzle. The discharge nozzle is connected to the channel connected with the conveyance chamber, and has a level sensor for detecting the level of the semi-molten material, which helps to control the amount of semi-molten material in the melting basin.

The discharge nozzle is attached at an upward angle relative to the horizontal plane, which prevents dripping from the nozzle. The conveyance chamber has an outlet for draining off semi-molten material, facilitating the removal of residual material from the melting basin. Thermal efficiency is improved by forming the flow channel as an integrated part of the melting basin.

What is claimed is:

1. A pouring apparatus for castings comprising:

solid material supply means for supplying solid material into a melting basin, the solid material supply means comprising a piston rod configured to push a billet of the solid material into a billet input port and through a transit port in a shield block to the melting basin;

a conveyance chamber communicating with the melting basin via a communication passage;

a plunger driven to advance into and retract from the conveyance chamber for shutting off the communication passage when moving into the conveyance chamber;

a discharge nozzle connected to the conveyance chamber via a channel; and a level sensor provided in the channel for sending an advancing signal to the plunger when semisolid material charged into the channel has reached a predetermined position.

2. A pouring apparatus according to claim 1, wherein the solid material supply means is connected to the melting basin at a prescribed angle of inclination to a horizontal plane.

3. A pouring apparatus according to claim 1, wherein the melting basin is configured to be held sealed while the solid material is melted into semisolid material.

* * * * *